US006084340A

United States Patent [19]

Bachmann et al.

[11] Patent Number: 6,084,340

[45] Date of Patent: Jul. 4, 2000

[54] ELECTRON EMITTER WITH NANO-CRYSTALLINE DIAMOND HAVING A RAMAN SPECTRUM WITH THREE LINES

[75] Inventors: Peter Bachmann, Würselen; Detlef Wiechert, Aachen; Klaus Rademacher, Kall-Benenberg; Howard Wilson, Aachen, all of Germany

[73] Assignee: U.S. Philips Corporation, New York, N.Y.

[21] Appl. No.: 09/253,082

[22] Filed: Feb. 19, 1999

Related U.S. Application Data

[63] Continuation of application No. PCT/IB98/00980, Jun. 25, 1998.

[30] Foreign Application Priority Data

Jun. 28, 1997 [DE] Germany ..... 197 27 606

[51] Int. Cl.[7] ..... H01J 1/05; H01J 1/02; H01J 63/04; H01J 1/16

[52] U.S. Cl. ..... 313/311; 313/309; 313/336; 313/351; 313/495

[58] Field of Search ..... 313/309, 311, 313/336, 351, 495–97, 346 R; 445/50.51

[56] References Cited

U.S. PATENT DOCUMENTS

| | | | |
|---|---|---|---|
| 5,623,180 | 4/1997 | Jin et al. | 313/497 X |
| 5,726,524 | 3/1998 | Debe | 313/309 |
| 5,777,427 | 7/1998 | Tanaka et al. | 313/309 |
| 5,808,401 | 9/1998 | Jin et al. | 313/495 X |

FOREIGN PATENT DOCUMENTS

| | | | |
|---|---|---|---|
| 0709869A1 | 5/1996 | European Pat. Off. | H01J 1/30 |

*Primary Examiner*—Michael H. Day
*Assistant Examiner*—Mack Haynes

[57] ABSTRACT

In an electron-emitting component with a cold cathode comprising a substrate and a cover layer with a diamond-containing material consisting of nano-crystalline diamond having a Raman spectrum with three lines, i.e. at K=1334±4 $cm^{-1}$ with a half-width value of 12±6 $cm^{-1}$, at K=1140±20 $cm^{-1}$ and at K=1470±20 $cm^{-1}$, the cold cathode exhibits a low extraction field strength, a stable emission at pressures below $10^{-4}$ mbar, a steep current-voltage characteristic and stable emission currents in excess of 1 microampere/$mm^2$. The electron emission of the component demonstrates a long-time stability, and a constant intensity of the electron beam across its cross-section.

4 Claims, 3 Drawing Sheets

ELECTRON EMITTER WITH NANO-CRYSTALLINE DIAMOND HAVING A RAMAN SPECTRUM WITH THREE LINES

RELATED APPLICATIONS

This application is a continuation of application Ser. No. PCT/IB98/00980 filed Jun. 25, 1998.

BACKGROUND OF THE INVENTION

The invention relates to an electron-emitting component with a field-emitting cold cathode comprising a substrate and a cover layer with a diamond-containing material. Such a component can suitably be used in flat display screens, for generating light, in electron microscopes and in other fields of application in which cold cathodes are employed.

A component of the type mentioned in the opening paragraph generally comprises, in addition to the cold cathode, an anode which is arranged at some distance from the cold cathode. An electric field is applied between the anode and the cathode so as to bring about electron emission from the cathode surface. The electron current can be controlled by a control device. To bring about a cold emission, that is, an electron emission without heating the cathode, it is necessary to apply very high field voltages between the anode and the cathode or to construct the surface of the cold cathode in such a manner that the electrons have a low work function.

Layers of diamond-containing material can very suitably be used as electron-emitting cover layers of cold cathodes, because they have a low work function and the energy of the emanating electrons exhibits a low degree of scattering. In addition, diamond exhibits an excellent heat conductance, chemical inertness and resistance to wear.

In EP-A-0 709 869 a description is given of a diamond field emitter for emitting electrons at low voltages, which emitter comprises a substrate and, deposited on said substrate, a diamond-containing material which is characterized by a line in the Raman spectrum for diamond at 1332 $cm^{-1}$, which has been broadened to a half-width value of 5–15 $cm^{-1}$, said diamond-containing material emitting electrons with a current density of at least 0.1 $mA/mm^2$ in a field of 25 $V/\mu m$ or less, and said emitter further comprising means for electrically contacting this field emitter. The diamond-containing material comprises "diamond islands" having a grain-size diameter below 10 $\mu m$, which diamond islands preferably have sharp tips or facets.

In the case of the above-mentioned surface morphology, electron emission preferably takes place from the tips of the relevant diamond islands. As a result, the homogeneity of the electron emission from such layers is not uniform.

SUMMARY OF THE INVENTION

Therefore, it is an object of the invention to provide an electron-emitting component which is characterized by a uniform cold, field-induced electron emission at low extraction field strengths.

In accordance with the invention, this object is achieved by an electron-emitting component with a cold cathode comprising a substrate and a cover layer with a diamond-containing material consisting of nano-crystalline diamond having a Raman spectrum with three lines, at K=1334±4 $cm^{-1}$ with a half-width value of 12±6 $cm^{-1}$, at K=1140±20 $cm^{-1}$ and at K=1470±20 $cm^{-1}$. A cold cathode with a cover layer comprising such a diamond-containing material of nano-crystalline diamond exhibits a low extraction field strength, a stable emission at pressures below $10^{-4}$ mbar, a steep current-voltage characteristic and stable emission currents above 1 microampere/$mm^2$. The electron emission exhibits a long-time stability, and the intensity of the electron beam is constant across its cross-section.

Within the scope of the invention it is preferred that the cover layer has a thickness in the range from 5 nm to 700 nm, and an average surface roughness in the range from 5 nm to 500 nm.

Within the scope of the invention it is also preferred that the diamond-containing material is doped with boron, nitrogen, phosphor, lithium, sodium or arsenic to lower the electric resistance of the material.

It is further preferred that the doping-concentration in the diamond-containing material ranges from 5 ppm to 5000 ppm.

These and other aspects of the invention will be apparent from and elucidated with reference to the embodiments described hereinafter.

DETAILED DESCRIPTION OF THE INVENTION

Figure 1:
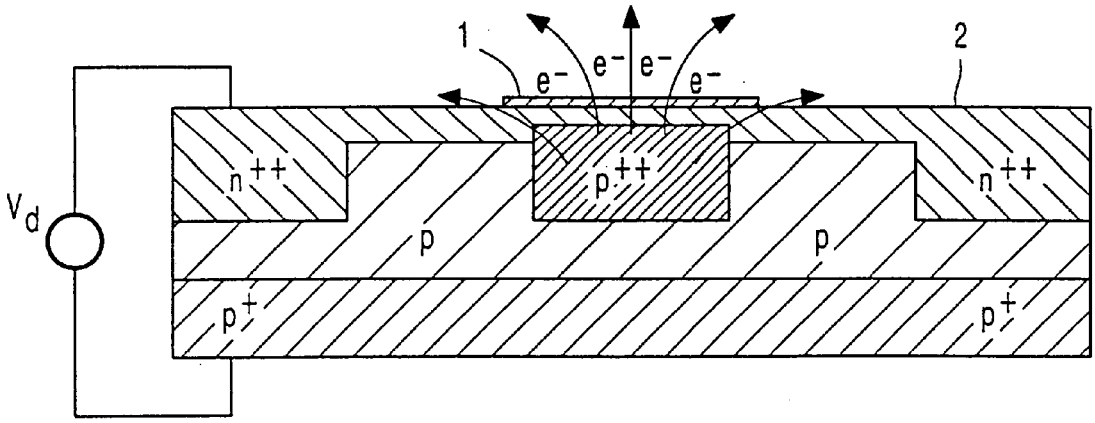
FIG. 1 shows an electron-emitting component with a cold cathode.

The invention will now be described in greater detail with reference to the figures of the drawing and the examples that follow.

FIG. 1 shows a component in accordance with the invention comprising a substrate 2 which is preferably composed of doped silicon layers. Said substrate may alternatively be composed of other materials such as II–V semiconductors, molybdenum or glass. The substrate is provided with a cover layer 1 comprising a diamond-containing material. The component further includes electrical contacting means and means for applying the extraction field strength.

The nominal thickness of the cover layer comprising a diamond-containing material, measured by means of ellipsometry, generally ranges from 5 nm to 700 nm. The average roughness (rms) of the layers, measured by differential light scattering or mechanical scanning, ranges from 5 nm to 500 nm. The diamond-containing material in accordance with the invention exhibits, in the Raman spectrum, the Raman line at 1334 $cm^{-1}$± which is typical of diamond, which line has a half-width value of 12±6 $cm^{-1}$ which is clearly wider than the line width of 2 to 3 $cm^{-1}$ measured on a diamond single crystal. The diamond-containing material further demonstrates two characteristic lines in the Raman spectrum at 1140±20 $cm^{-1}$ and at 1470±20 $cm^{-1}$, which lines are dependent upon the grain size.

The cover layer comprising the diamond-containing material is thin, very fine-crystalline and smooth. Said layer includes a nano-crystalline diamond phase with the above-mentioned Raman spectrum as the electron emitter and, optionally, further carbon-containing phases.

The diamond-containing material has a negative electron affinity. To reduce the electric resistance and hence the extraction field strength, said diamond-containing material may be doped with one or more of the elements boron, nitrogen, phosphor, lithium, sodium or arsenic. Preferably, boron is used as the dopant.

The cover layer comprising a diamond-containing material is manufactured by means of microwave-plasma-CVD from a gas mixture of a carbon-containing gas comprising hydrogen, oxygen, halogens and/or an inert gas. To deposit doped nano-crystalline diamond layers, the gas phase is doped, for doping with boron, with boron chloride or diborane, for doping with nitrogen, with nitrogen or ammonia, for doping with phosphor, with phosphor chloride, for doping with lithium and sodium, with the corresponding metal vapors, and for doping with arsenic, with arsenic chloride.

EXAMPLE 1

Figure 2:
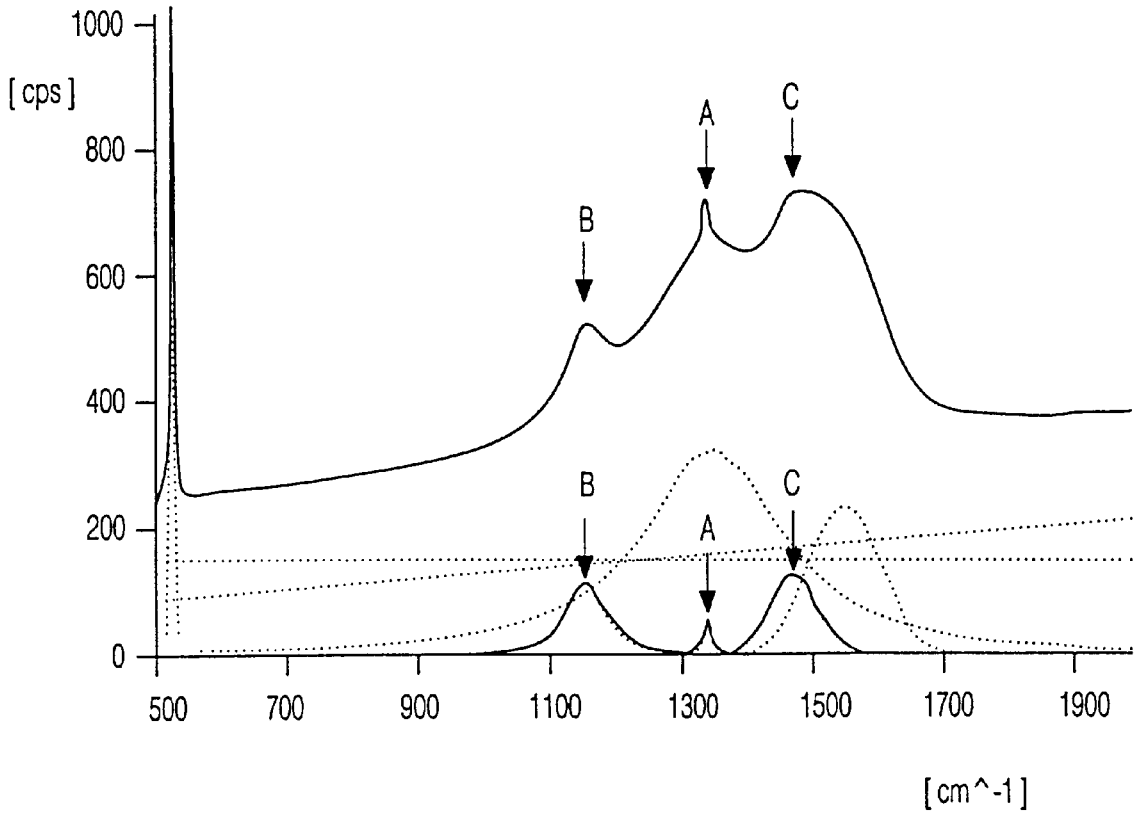
FIG. 2 shows the Raman spectrum of the nano-crystalline diamond in accordance with example 1.

In a microwave plasma-CVD-reactor, a gas discharge is ignited, at a microwave power of 3.8 kW and a pressure of 180 mbar, in a gas mixture of hydrogen containing 1% methane with an overall gas flow of 500 sccm. The deposition takes place on a substrate of n-doped silicon (resistance<100 Ωcm) at a substrate temperature in the range from 550° to 600° C. After a coating-process duration of 12 minutes, the layer of nano-crystalline diamond has a thickness of 150 nm. The Raman spectrum of this layer is shown in FIG. 2.

EXAMPLE 2

Figure 3:
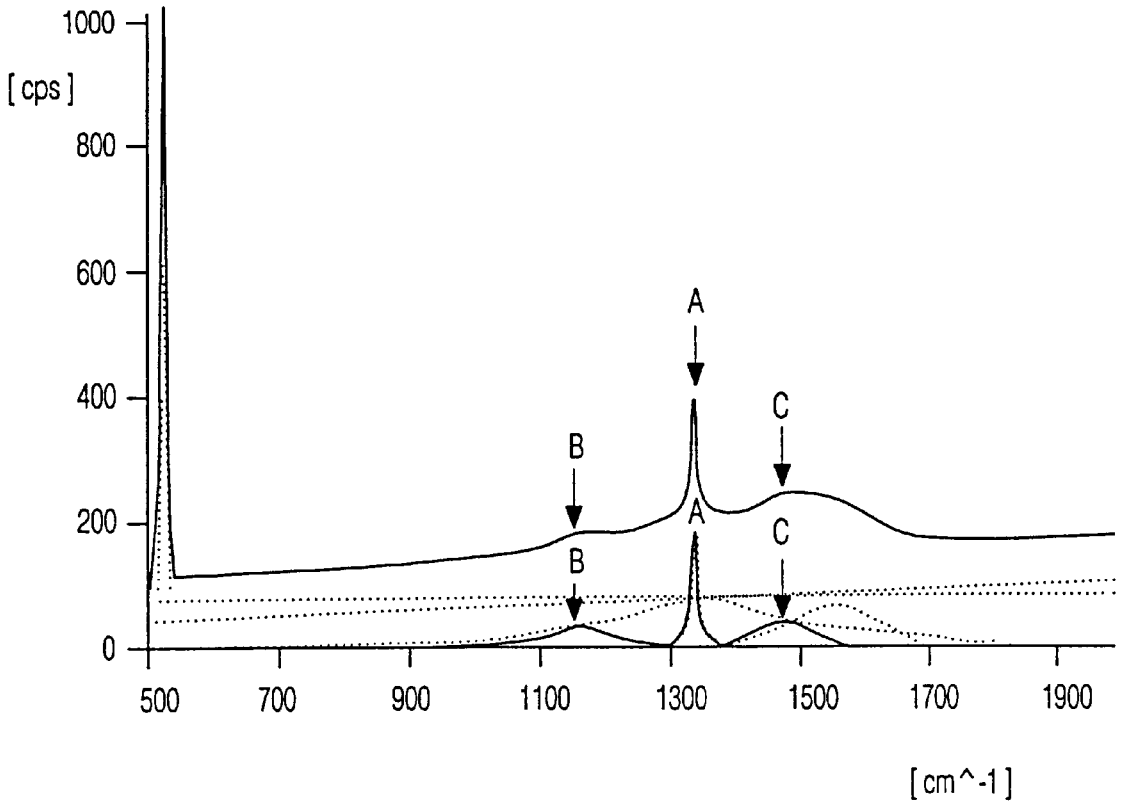
FIG. 3 shows the Raman spectrum of the nano-crystalline diamond in accordance with example 2.

In a microwave plasma-CVD-reactor, a gas discharge is ignited, at a microwave power of 0.8 kW and a pressure of 16 mbar, in a gas mixture of 17.3 sccm $O_2$ and 23.1 sccm acetone. The deposition takes place on a substrate of p-doped silicon (resistance<100 Ωcm) at a substrate temperature of 780° C. After a coating-process duration of 16 h, the layer of nano-crystalline diamond has a thickness of 3$\mu$. The Raman spectrum of this layer is shown in FIG. 3.

Characterization

The nano-crystalline diamond material is characterized by its Raman spectrum together with the X-ray diffraction spectrum. The identification of the spectral lines the Raman spectrum is aided by the mathematical explanation of the spectrum by means of a peak-analysis computer program. FIG. 2 and FIG. 3 show the corresponding breakdown of the measured spectrum and the position of the relevant lines, their line width and intensity, as well as the ratio of the intensities relative to each other.

Figure 4A:
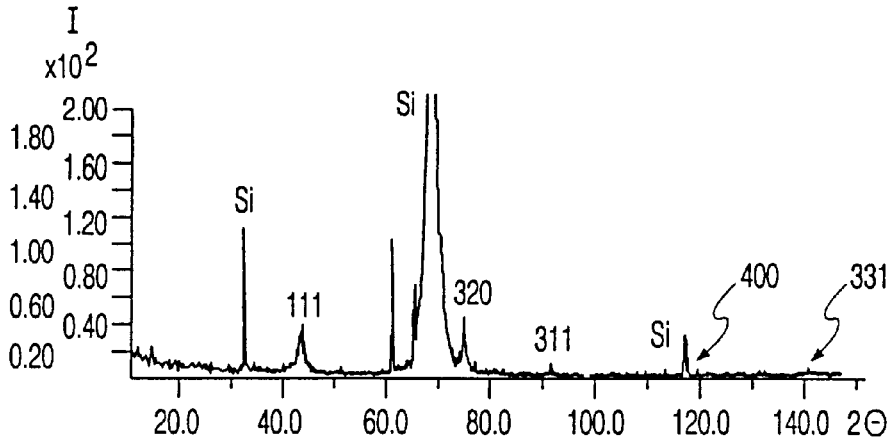
FIGS. 4A, 4B and 4C shows the X-ray diffraction spectrum of the nano-crystalline diamond in accordance with examples 1 and 2.
Figure 4B:
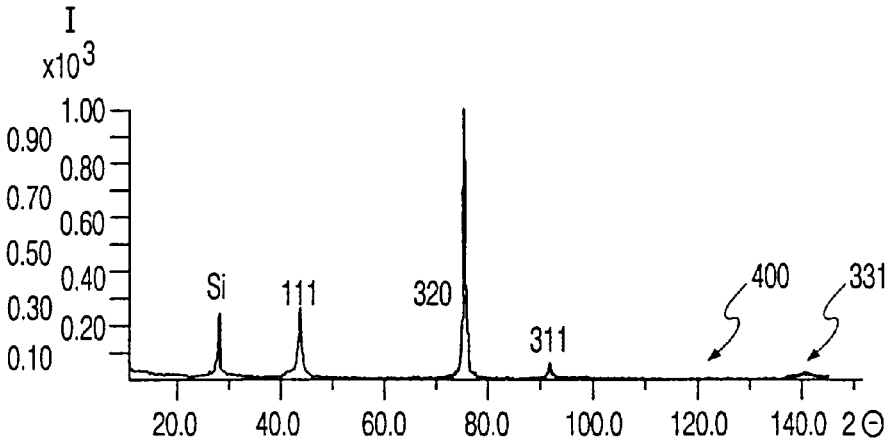
Figure 4C:
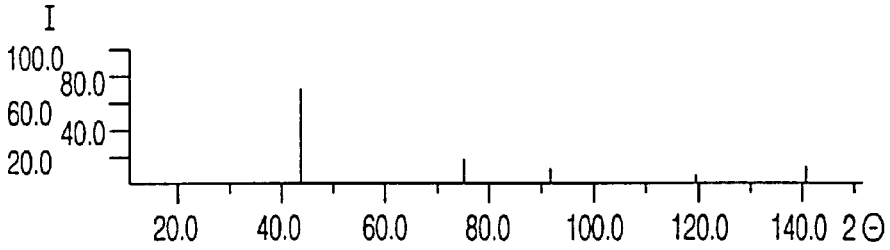

FIGS. 4A, 4B and 4C shows the characteristic X-ray diffraction spectrum (Cu $K\alpha_1$) of the layers in accordance with examples 1 and 2. The diffraction lines of diamond are clearly recognizable and marked with the relevant lattice indices.

What is claimed is:

1. An electron-emitting component with a cold cathode comprising a substrate and a cover layer with a diamond-containing material, characterized in that the diamond-containing material consists of nano-crystalline diamond having a Raman spectrum with three lines, i.e. at K=1334±4 $cm^{-1}$ with a half-width value of 12±6 $cm^{-1}$, at K=1140±20 $cm^{-1}$ and at K=1470±20 $cm^{-1}$.

2. An electron-emitting component as claimed in claim 1, characterized in that the cover layer has a thickness in the range from 5 nm to 700 nm, and an average surface roughness in the range from 5 nm to 500 nm.

3. An electron-emitting component as claimed in claim 1, characterized in that the diamond-containing material is doped with boron, nitrogen, phosphor, lithium, sodium or arsenic.

4. An electron-emitting component as claimed in claim 3, characterized in that the doping-concentration in the diamond-containing material ranges from 5 ppm to 5000 ppm.

* * * * *